US006019546A

United States Patent [19]

Ruiz

[11] Patent Number: 6,019,546

[45] Date of Patent: Feb. 1, 2000

[54] SUPPORT FOR LOAD TRANSFER DEVICE FOR CONCRETE CONSTRUCTIONS

[75] Inventor: Hector G. Ruiz, Dallas, Tex.

[73] Assignee: Meadow-Burke Products, Tampa, Fla.

[21] Appl. No.: 09/143,743

[22] Filed: Aug. 31, 1998

[51] Int. Cl.[7] ..... E01C 11/18

[52] U.S. Cl. ..... 404/134; 404/136

[58] Field of Search ..... 404/70, 134, 135, 404/136

[56] References Cited

U.S. PATENT DOCUMENTS

| | | | |
|---|---|---|---|
| 943,402 | 12/1909 | Ferguson . | |
| 1,119,123 | 12/1914 | Schoenthaler . | |
| 1,567,211 | 12/1925 | Tubbs . | |
| 2,134,533 | 10/1938 | Reiland | 72/122 |
| 2,768,562 | 10/1956 | Godwin | 94/8 |
| 2,864,289 | 12/1958 | De Canio | 404/136 X |
| 3,104,600 | 9/1963 | White | 94/8 |
| 3,397,626 | 8/1968 | Kornick | 94/8 |
| 3,895,470 | 7/1975 | Würth | 52/686 |
| 4,890,959 | 1/1990 | Robishaw | 405/204 |

*Primary Examiner*—James A. Lisehora
*Attorney, Agent, or Firm*—Pettis & Van Royen, P.A.

[57] ABSTRACT

The invention relates to supports for a device for transferring weight loads from one concrete structure to another. The device is particularly suited for concrete highway construction. The supports are used to position joint dowels that extend across paving joints between adjoining concrete slabs. The supports comprise a first and second support each positioned on opposing sides of the paving joint. The first support comprises a pair of legs that holds one end of the dowel therebetween and the dowel is then manually locked to that support by a pin lock.

6 Claims, 4 Drawing Sheets

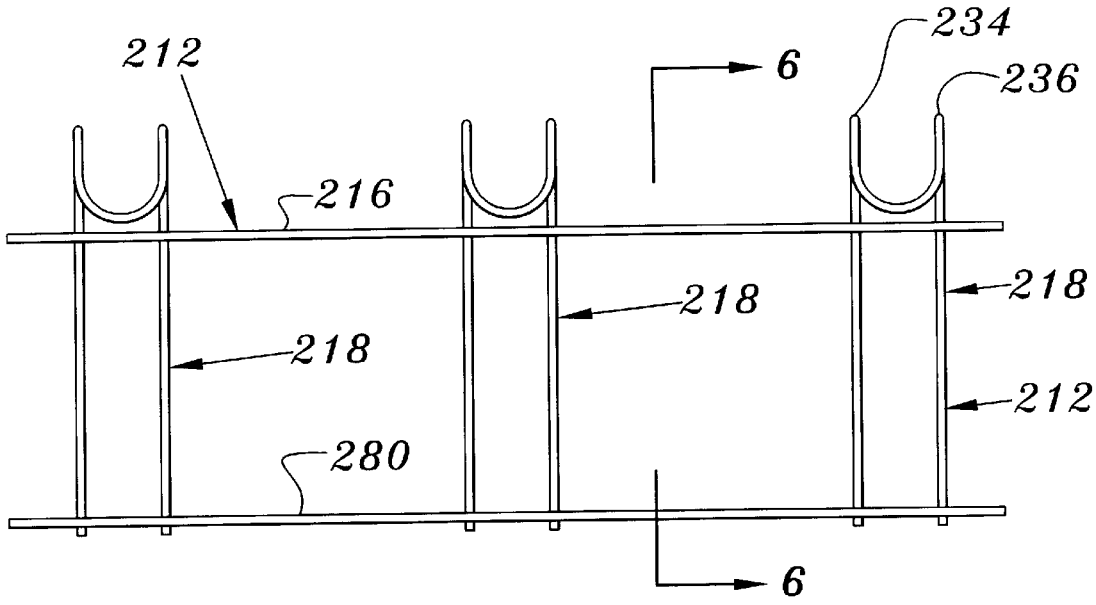
FIG. 4
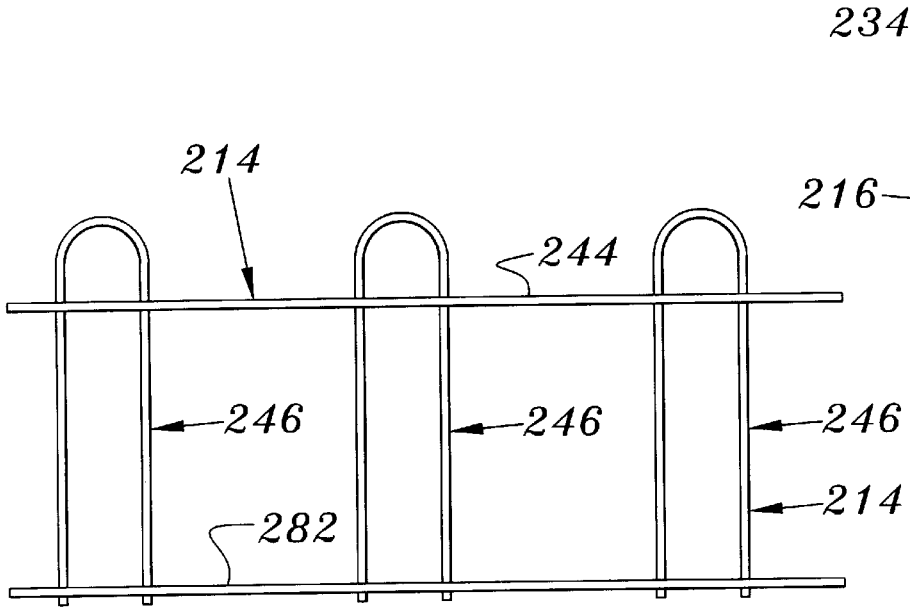
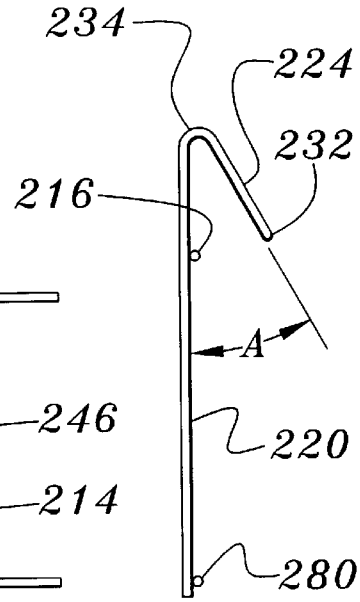
FIG. 5
FIG. 6

SUPPORT FOR LOAD TRANSFER DEVICE FOR CONCRETE CONSTRUCTIONS

BACKGROUND OF THE INVENTION

1. Field of the Invention

The present invention relates to a support device for transferring moving loads from one concrete structure to an adjacent concrete structure. The device being particularly relevant for maintaining the spacial relationship between adjoining concrete paving slabs that are spaced apart by a paving joint.

2. Description of the Prior Art

The use of joint dowels to tie adjoining paving slabs is well known in the art. These dowels are positioned within the concrete formwork, when formwork is used, prior to pouring the concrete so that the dowels extend through the paving joints and are encased in both of the adjoining paving slabs. When slip form paving equipment is being used, the dowels are positioned on the subgrade spaced inwardly from the future longitudinal edge of the slab. The dowels prevent vertical movement between adjoining slabs at a paving joint so that a load moving from one of the slabs is smoothly transferred to the adjacent slab. There are many different types of concrete paving joints that use load transfer devices. The most prevalent are transverse contraction joints, formed to compensate for the shrinkage that occurs in freshly poured concrete. Other paving joints include transverse and longitudinal expansion joints, transverse and longitudinal construction joints and longitudinal contraction joints. During construction the dowels are positioned in the forms at a predetermined distance from the bottom of the slab and are spaced along the paving joint.

Various devices exist that support and hold the dowels in the proper position during the pour of the concrete slab. For example U.S. Pat. No. 2,768,562, issued to William S. Godwin discloses a rather complex arrangement of supports that requires a large amount of labor for field assembly, including attachment of the supports to the sides of the forms. The dowels are maintained longitudinally by a pair of baskets that are formed by welding and are fitted to a support frame.

In U.S. Pat. No. 3,397,626 issued to J. B. Kornick et al., the dowels extend between loops formed in opposing frames. To hold the dowels firmly in place they are welded to one of the loops. This welding operation must be accomplished at the plant where the wire frames are constructed or must be welded in the field, increasing the costs.

Since it is highly desirable that the dowels be held firmly in place during the pouring of the concrete, many support systems require that the dowels be tack welded to a support frame before it is delivered to the construction site. Such requirements increase the assembly and transportation cost, as the frames with the tack welded dowels attached are bulky and awkward to ship. This method of assembly has reduced the labor in the field but has increased the fabrication and shipping costs. Therefore, what is needed is a device where the dowels may be easily locked to the support frames in the field with little labor required.

It has been pointed out that the prior art is either so complex that it is expensive to make; or requires welding at the plant or in the field increasing the cost for labor or transportation. Therefore, it remains clear that there is a need for a device to support load transfer dowels that is simple to manufacture, easily stacked for transportation and easily installed in the field, providing a tight connection without welding.

SUMMARY OF THE INVENTION

The present invention comprises a support for load transfer devices that is inexpensive to manufacture, easy to transport and easy to install in the field. The device is particularly suited for highway construction, and for clarity the specification will be directed to highway construction. However, the support may be used in the assembly of other concrete structures that require dowels or reinforcing bars to join adjacent concrete parts.

There are many different types of concrete paving joints that use load transfer devices. The most prevalent are transverse contraction joints, formed to compensate for the shrinkage that occurs in freshly poured concrete. Other paving joints include transverse and longitudinal expansion joints, transverse and longitudinal construction joints and longitudinal contraction joints.

Most simply stated, the device comprises a first and a second support that are positioned on a roadbed subgrade so that they are spaced apart from one another on opposing sides of a concrete paving joint separating adjoining slabs. One of the supports extends between the planned longitudinal edges of one of the adjoining slabs, and the other support extends between the planned longitudinal edges of the other slab. The first and second supports position the dowels so that they extend across the paving joint at a predetermined height above the subgrade at predetermined intervals and generally parallel to the longitudinal edges of the concrete pavement.

The first support comprises a first member that extends longitudinally the full length of the first support. An element is attached to the first member at a location that has been predetermined for placement of a dowel. The element is comprised of a pair of legs, each of which has a first end that are connected to one another. The first and second legs of the element are attached to the first member proximal the first end of each leg. Both legs are bent back upon themselves to a predetermined angle at a point intermediate the first end of each leg and the point at which the leg is attached to the first member creating a bend in each leg. The legs of the element are spaced apart to receive a dowel that has a predetermined diameter so that the dowel engages the legs where they are joined to one another and engages the first member. A second support is spaced apart from the first support on the opposing side of the expansion joint and is configured to support the other end of the dowel.

A pin lock is sized and configured to be received adjacent to the interior portion of the first and second bends of the element. Therefore, when a dowel is received by the element and the pin lock is inserted the pin lock engages the interior portions of the first and second bends of the element and the dowel, locking the dowel in place.

The invention accordingly comprises an article of manufacture possessing the features, properties and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which:

FIG. 4 is a detailed front elevational view of one of the supports of the device of FIG. 1 illustrating a second embodiment in which a plurality of elements are attached to the first member;

FIG. 5 is a detailed front elevational view of the other on of the supports of FIG. 1 illustrating a second embodiment in which a plurality of parts are attached to the second member;

FIG. 6 is a cross sectional view taken along line 6—6 of FIG. 4;

Similar reference characters refer to similar parts throughout the several views of the drawings.

DESCRIPTION OF A PREFERRED EMBODIMENT

Figure 1:
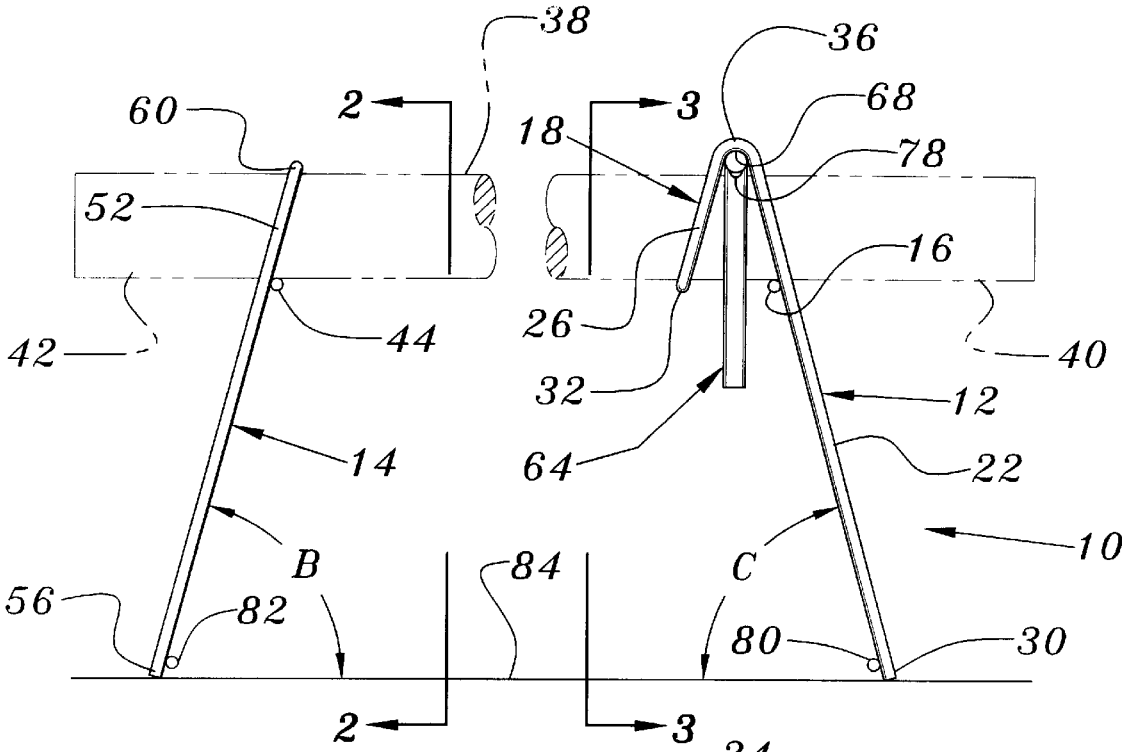
FIG. 1 is a right side elevational view of the supports for a load transfer device.
Figure 2:
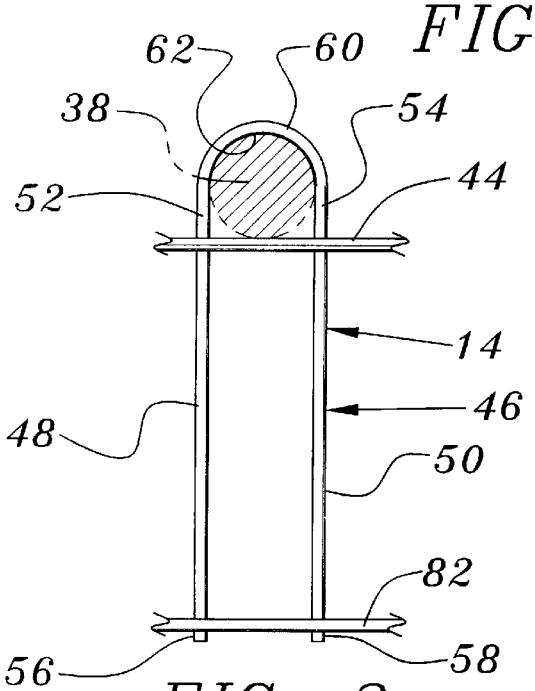
FIG. 2 is a cross sectional elevational view taken along line 2—2 of FIG. 1.
Figure 3:
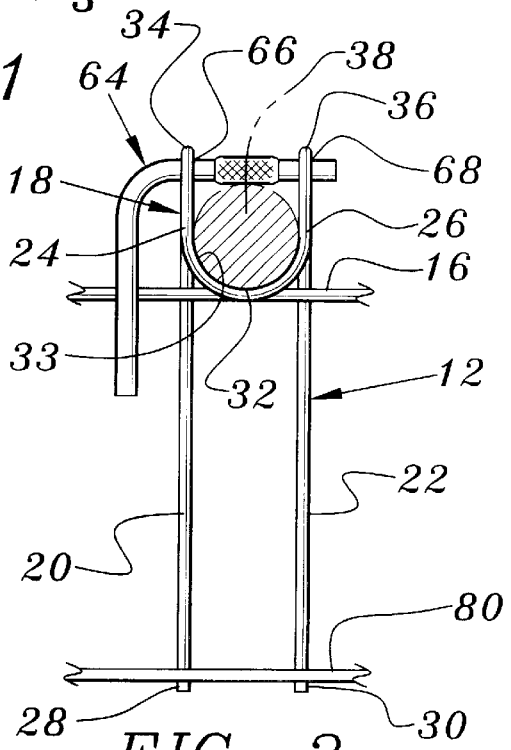
FIG. 3 is a cross sectional elevational view taken along line 3—3 of FIG. 1.
Figure 8:
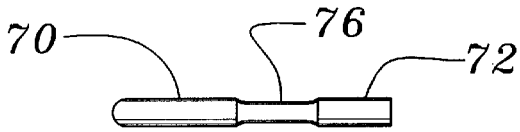
FIG. 8 is a top plan view of the pin lock of FIG. 7.
Figure 9:
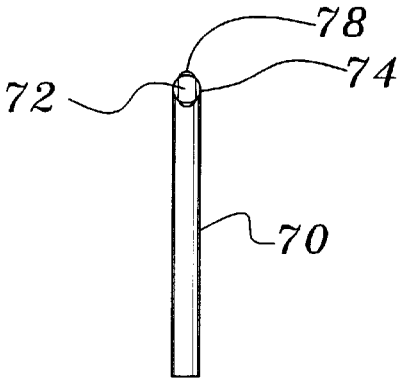
FIG. 9 is a right side elevational view of the pin lock of FIG. 7.
Figure 10:
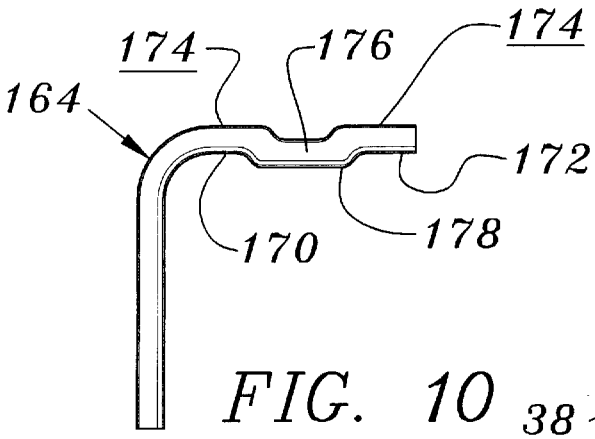
FIG. 10 is a front elevational view of a second embodiment of the pin lock of FIG. 7.

A preferred embodiment for the supports for a load transfer device is illustrated in the drawing FIGS. 1–3, 6–9, 11 and 12. FIGS. 4 and 5 illustrate a second preferred embodiment of the invention of FIG. 1. FIG. 10 illustrates a second preferred embodiment of the pin lock of this invention and the reference numbers of this figure are incremented by 100 to indicate similar parts. The supports for a load transfer device are indicated generally as 10 in the views of FIGS. 1–3, 11 and 12. Referring first to FIG. 1, it can be seen that the supports for a load transfer device 10 comprise a first support 12 and a second support 14. As seen in FIG. 3, the first support comprises a first member 16 and an element 18 that is attached to the first member 16. The element 18 comprises a first leg 20 and a second leg 22, each having a respective first end 24 and 26 and a respective second end 28 and 30. In the preferred embodiment illustrated, the legs 20 and 22 are generally parallel to one another; however, in other preferred embodiments they may be formed more as an A-frame with the first ends 28 and 30 being spaced apart further from one another than the first ends 24 and 26. The first ends 24 and 26 are connected to one another. In a preferred embodiment, the first end 24 of the first leg 20 is connected to the first end 26 of the second leg 22 by being contiguously joined to one another by a curved portion 32. In other embodiments the portion 32 may be generally straight, but a curvature is preferred. As shown in FIG. 1 and FIG. 3, the first leg 20 and the second leg 22 are each bent back upon themselves to form a first bend 34 in the first leg and a second bend 36 in the second leg 22. FIG. 4, illustrates a second embodiment of the invention 10, in which a plurality of elements 218 are attached to the first support 216. The form of the element 18 and the element 218 are the same; therefore, as shown in FIG. 6, the angle A formed by the first bend 234 is the same angle A for all the bends: first bend 34, second bend 36, first bend 234 and second bend 236.

As shown in FIG. 1, the first support 12 and the second support 14 are configured to receive a dowel 38 (shown in phantom as the dowel is not an element of this invention). In FIG. 3, the curved portion 32 and the first member 16 of the first support 12 are seen to cradle the first end 40 of the dowel 38, while the second support 14 is configured to support the second end 42 of the dowel 38. In a preferred embodiment, the curved portion 32, has a radius of curvature similar to that of the dowel 38 for which the element 18 is designed to support.

As seen in FIGS. 1 and 2, the second support comprises a second member 44 and a part 46 that is attached to the second member 44. The part 46 is comprised of a pair of arms 48 and 50 that each have a first end, respectively 52 and 54, and a second end, respectively 56 and 58. The first ends 52 and 54 of the arms 48 and 50 are connected to one another. In a preferred embodiment, the first ends 52 and 54 are contiguously joined to one another by an arcuate portion 60, however in other embodiments the connecting portion 60 may be straight. The arcuate portion 60 is sized and configured for receipt of the second end 42 of the dowel 48 which engages the interior of the arcuate portion 60 and the second member 44 when the dowel is mounted in the supports to create a load transfer device. In a preferred embodiment the radius of curvature of the arcuate portion 60 is similar to the radius of curvature of the dowel 38 for which it is designed. The arms 48 and 50 of the part 46 may be parallel or formed in an A-frame shape, as described previously for the element 18.

Figure 7:
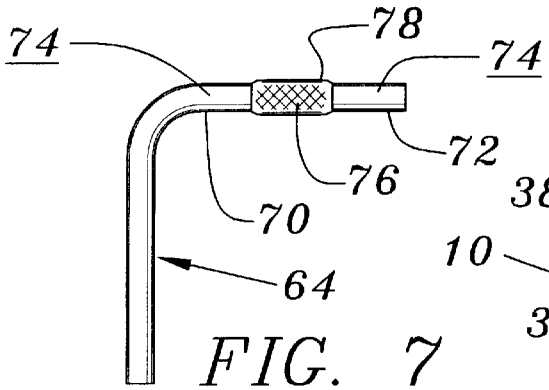
FIG. 7 is a detailed front elevational view of the pin lock of the invention of FIG. 1.

A pin lock, shown generally as 64 is comprised of a rod that is sized and configured to be received adjacent to the interior portion 66 of the first bend 34 and the interior portion 68 of the second bend 36. The pin lock 64 then engages the interior portions 66 and 68 while simultaneously engaging the dowel 38, when such a dowel is supported thereby. In the preferred embodiment, as shown in FIGS. 7, 8 and 9, the pin lock 64 comprises a first section 70 and a second section 72 that are both generally cylindrical and have an exterior surface 74. A third section 76 lies intermediate the first section 70 and the second section 72. As can be seen in FIGS. 7 and 9 a portion 78 of the third portion 76 extends outwardly beyond the generally cylindrical exterior surface 74 of the first section 70 and the second section 72. The enlarged third section 76 of the pin lock 64 is formed by swaging, or other well known means. A portion of the first section 70 may be bent at a right angle to assist in the rotation of the pin lock 64 when it is inserted between the dowel 38 and the first bend 34 and the second bend 36. A right cross section of the first section 70 and the second section 72 comprises a circle so that the pin lock may easily rotate against the interior 66 of the bend 34 and the interior 68 of the bend 36. In other embodiments the cross sections may comprise a plurality of sides and work similarly.

FIG. 10 discloses a second embodiment of the pin lock 164, whose first section 170 and second section 172 are constructed in the same fashion as the first and second sections of the pin lock 64. The third section 176 of pin lock 164 is bent so that it is offset from the first and second sections, and so that a portion 178 of the third section 176 extends outwardly beyond the exterior surface 174 of the first section 170 and the second section 172.

Figure 11:
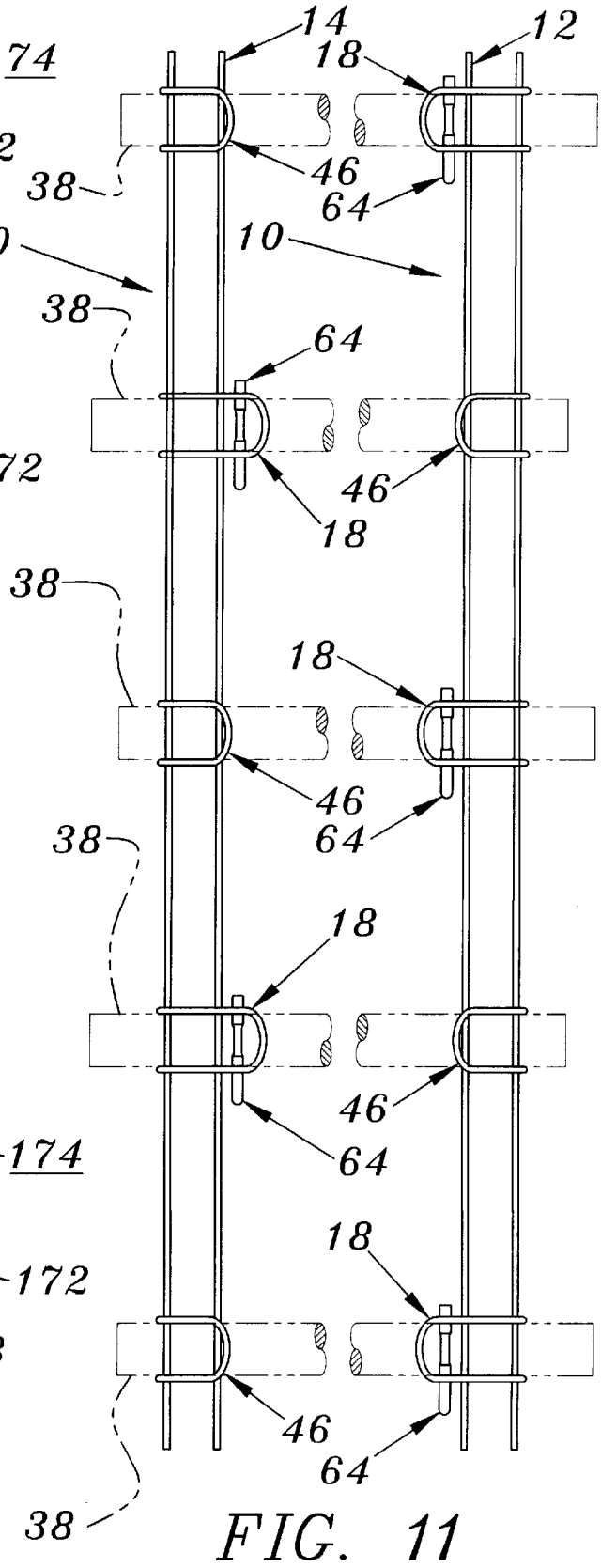
FIG. 11 is a top plan view of the invention of FIG. 1 illustrating a plurality of elements and a plurality of parts attached to each support.

As shown in FIG. 4, one preferred embodiment of the first support 212 comprises a plurality of elements 218 that are attached to the first member 216 to support a plurality of dowels. FIG. 5 illustrates the second support 214 that is comprised of a plurality of parts 246 attached to the second member 244 to correspond with the elements 218 on the first support. In another preferred embodiment, as shown in FIG. 11, both the first support 12 and the second support 14 are configured by alternating the elements 18 with the parts 46. When positioned during construction, a part 46 will oppose an element 18 so that each dowel 38 may be locked to one of the supports 12 or 14. Alternating the elements with the parts provides a more stable load transfer device as the dowels will be alternately locked to the first support 12 and to the second support 14, creating a fixed spacing between the supports 12 and 14. To further increase the stability and strength of the first support a third member 80 has been attached proximal to the second end of each leg, for example, in FIG. 3 third member 80 is attached to the leg 20 proximal the second end 28 and is attached to the leg 22 proximal the second end 30. To further strengthen the second support 14 a fourth member 82 is attached to the first arm 48 proximal the second end 56 of the first arm 48 and proximal the second end 58 of the second arm 50.

The supports 10 for a load transfer device are sized and configured for a particular sized dowel as it is preferable that the inside 33 of the curved portion 32 and the inside 62 of the arcuate portion 60 have the same radius as the dowel that is to be received therein. However, as shown in FIG. 1 there must be sufficient clearance between the second member 44 and the arcuate portion 60 so that the second support can engage the dowel 38 at an angle so that when the second ends 56 and 58 of the arms rest on the subgrade 84, the arms will engage the subgrade 84 at an angle B which in a preferred embodiment is approximately 75 degrees.

In a preferred embodiment, the distance from the bends 34 and 36 the point at which the first member 16 is attached to the legs and the distance from the bends 34 and 36 to the peak of the curved portion 32, are generally equal. By forming angle A at 30 degrees, the legs 20 and 22 will engage the subgrade 84 at angle C, approximately 75 degrees. By angling the upper portions of the first support 12 and the second support 14 toward one another, greater stability of the completed load transfer device will be attained. This angle may be increased or decreased with considerable latitude, however 75 degrees is preferred.

All the parts for the supports 10 for the load transfer device are made from cold drawn steel wire that is formed in the appropriate shapes and welded where the parts are joined. Usually the parts are made from mild steel, but the requirements of a particular construction project dictate. For example, highways are constructed to specifications prepared by the individual states or by the federal government. Frequently these specifications require that metal parts meet the American Society for Testing Materials standard A-82 (ASTM A-82).

Figure 12:
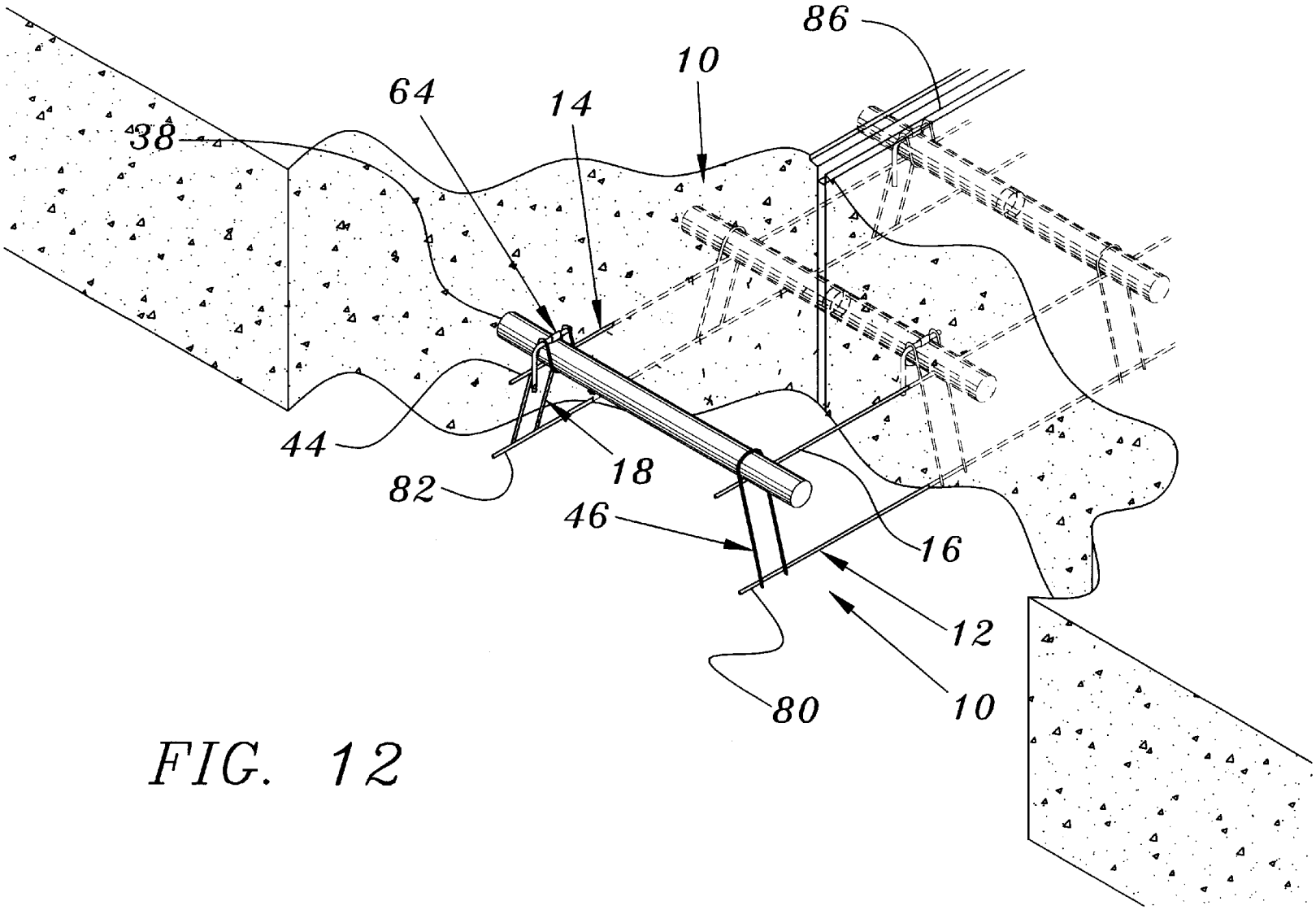
FIG. 12 illustrates the invention of FIG. 1 installed adjacent the paving joint between two concrete slabs.

Having thus set forth a preferred construction for supports for a load transfer device 10 of this invention, it is to be remembered that this is but a preferred embodiment. Attention is now invited to a description of the use of the supports 10 with dowels 38 to create a load transfer device. The design of a particular project will require the use of dowels across concrete joints, such as paving joint 86, as shown in FIG. 12. These specifications will indicate the height at which the dowels are to be placed above a prepared subgrade, or other surface, their spacing, and their length and diameter. There are many different types of concrete paving joints that use load transfer devices. The most prevalent are transverse contraction joints, formed to compensate for the shrinkage that occurs in freshly poured concrete. Other paving joints include transverse and longitudinal expansion joints, transverse and longitudinal construction joints and longitudinal contraction. The present invention may be used to support reinforcing bars placed in a construction joint to tie two adjacent slabs together. Frequently for road projects, for example, a standard specification is used and supports can be manufactured to meet these standard that are suitable for many projects. The supports 10 are manufactured at a plant and shipped to the site. Supports 10 that utilize alternating elements 18 and parts 46, as in FIG. 11, provide great flexibility, as the first support 12 and the second support 14 are actually identical and a single structure is usable for each support. This simplifies the shipping and handling as dowels can be purchased and cut to size near the construction site, saving transportation costs. If the dowels were welded to the supports, fewer supports could be shipped in any one shipment due to the increased bulkiness and weight.

Placement of the supports at the job site is a very simple process. A first support 12 and a second support 14 are placed on opposing sides of the paving joint 86 which has been located on the subgrade. The dowels are inserted through the expansion joint so that one end is received by a part 46 and then the other end is placed between the legs 20 and 22 of an element 18 that lies opposite the part 46. The first support 12 and the second support 14 are then spread outwardly at the base to form the angles B and C of approximately 75 degrees. Once several dowels have been inserted into the supports 10 and the supports are properly spaced and aligned with the paving joint 86, pin locks 64 are inserted between the dowels 38 and the interior of the first bend 20 and the second bend 22. By rotation of the pin lock approximately 90 degrees, the portion 78 of the third section 76 that extends outwardly from the pin lock 64 frictionally engages the dowel 38 locking it in place. Now it is just a matter of inserting the remaining dowels 38 in each of the paired parts 46 and elements 18 and locking each of the dowels 38 to an element 18 with a pin lock 64. This configuration provides a sturdy support for the dowels 38 enabling concrete to be poured directly over the dowels without them becoming dislodged or misaligned. Certainly, in other embodiments the first support can be comprised entirely of elements 18 and the second support can be comprised entirely of parts 46; however, this configuration allows more movement between the two supports as the second support 14 is not locked to any of the dowels 38. The other negative to this configuration is that it would be necessary to sort the supports at the site ensuring that you have one of each at each expansion joint 86.

While the foregoing description is directed to particularly preferred embodiments of the present invention, it is to be understood that those embodiments are representative only of the principles of the invention and are not to be considered limitative thereof. Because numerous variations and modifications of the apparatus, all within the scope of the present invention, will become apparent to those skilled in the art, the scope of the invention is to be limited solely by the claims appended hereto.

Now that the invention has been described, What is claimed is:

1. Supports for a load transfer device comprising:

a first support comprising;

a first member;

an element comprising a first leg and a second leg, each leg having a first end and a second end, said first end of said first leg being connected to said first end of said second leg, said first leg being attached to said first member proximal said first end of said first leg, said first leg having a first bend formed therein intermediate said first end of said first leg and the point at which said first leg is attached to said first member, said second leg being attached to said first member proximal to said first end of said second leg, said second leg having a second bend formed therein intermediate said first end of said second leg and the point at which said second leg is attached to said first member, said first ends of said first and second legs being spaced apart for receipt of a dowel of predetermined diameter therebetween;

a second support spaced apart from said first support, being configured for support of a dowel; and a pin lock sized and configured to engage the interior portion of said first and second bends of said element, said pin lock comprising a rod, having a first section that engages one of said first and second bends of said element and a second section that engages the other one of said first and second bends of said element, said first and second sections of said rod being general cylindrical and having an exterior surface, said rod having a third section intermediate said first section and said second section, a portion of said third section extending outwardly beyond said exterior surface of said first second sections, whereby then a dowel is mounted to said first support, upon rotation of said rod said outwardly extending portion of said third section frictionally engages the dowel locking the dowel to said first support.

2. A device as in claim 1, wherein said first ends of said first and second legs are contiguously joined to one another by a curved portion.

3. A device as in claim 1, wherein said first support comprises a plurality of elements attached to said first member, each said element of said plurality of elements being spaced apart from one another and each being configured to receive a dowel therein, and said second support being configured to support a plurality of dowels.

4. A device as in claim 1, wherein said second support comprises;

a second member; and a part comprising a pair of arms, each arm having a first end and a second end, and said first ends of said arms being connected to one another, each arm of said pair of arms being attached to said second member proximal said first end of each said arm, said pair of arms being configured for receipt of the dowel therethrough.

5. A device as in claim 4 wherein said first ends of said pair of arms are contiguously joined to one another by an arcuate portion.

6. A device as in claim 4, wherein said first support and said second support each comprise a plurality of elements spaced apart from one another that are attached to said first member of said first support and said second member of said second support, and a plurality of parts, one of said plurality of parts being attached to said first member of said first support intermediate each pair of said elements attached to said first member, and one of said plurality of parts being attached to said second member of said second support intermediate each pair of said elements attached to said second member, whereby one end of a dowel is received by a part on one of said first and said second supports and the other end of the dowel is received by an element on the other one of said first and said second supports.

* * * * *

UNITED STATES PATENT AND TRADEMARK OFFICE

CERTIFICATE OF CORRECTION

PATENT NO. : 6,019,546
DATED : February 1, 2000
INVENTOR(S) : Hector G. Ruiz

It is certified that error appears in the above-indentified patent and that said Letters Patent is hereby corrected as shown below:

Column 7, line 18, delete "general" and insert therefore --generally--.
Column 7, line 23, after "first" insert --and--.
Column 7, line 24, delete "then" and insert therefore --when--.

Signed and Sealed this

Twelfth Day of September, 2000

*Attest:*

Q. TODD DICKINSON

*Attesting Officer*

*Director of Patents and Trademarks*